US006108016A

United States Patent [19]

Takizawa

[11] Patent Number: 6,108,016

[45] Date of Patent: Aug. 22, 2000

[54] IMAGE RECORDING DEVICE WHICH CONDUCTS IMAGE FORMATION BY DEVELOPMENT WITH COLORING SYSTEM

[75] Inventor: Fuminori Takizawa, Tokyo, Japan

[73] Assignee: NEC Corporation, Tokyo, Japan

[21] Appl. No.: 09/160,103

[22] Filed: Sep. 25, 1998

[30] Foreign Application Priority Data

Sep. 25, 1997 [JP] Japan ..... 9-260106

[51] Int. Cl.[7] ..... B41J 2/42

[52] U.S. Cl. ..... 347/114

[58] Field of Search ..... 347/111, 112, 347/113, 114, 139; 399/130, 132, 153

[56] References Cited

U.S. PATENT DOCUMENTS

| | | | |
|---|---|---|---|
| 3,824,098 | 7/1974 | Bergman, Jr. et al. . | |
| 3,899,969 | 8/1975 | Taylor . | |
| 3,946,401 | 3/1976 | Young | 347/114 |
| 4,636,815 | 1/1987 | Yuasa | 347/114 |
| 4,654,677 | 3/1987 | Tadauchi et al. | 347/114 |
| 5,107,282 | 4/1992 | Morohoshi et al. | 347/114 |
| 5,185,619 | 2/1993 | Snelling . | |
| 5,929,886 | 7/1999 | Snelling et al. | 347/114 |

FOREIGN PATENT DOCUMENTS

| | | |
|---|---|---|
| 0684531 | 11/1995 | European Pat. Off. . |
| 56-158350 | 12/1981 | Japan . |
| 60-119575 | 6/1985 | Japan . |
| 2-157864 | 6/1990 | Japan . |
| 5-134506 | 5/1993 | Japan . |
| 6-214441 | 8/1994 | Japan . |
| 8-62952 | 3/1996 | Japan . |
| 8-123161 | 5/1996 | Japan . |

OTHER PUBLICATIONS

J.G. Bergman, et al., "Applied Physics Letter" vol. 21 No. 10, *Pyroelectric copying process*, pp. 497–499, (Nov. 15, 1972).

*Primary Examiner*—Sandra Brase
*Attorney, Agent, or Firm*—Foley & Lardner

[57] ABSTRACT

The image recording device comprises a heating unit such as a thermal head for selectively heating a latent image charge holding medium which forms electrostatic latent image in order to form electrostatic latent image on the surface of the latent image charge holding medium, an ion radiator for electrically neutralizing the surface of the latent image charge holding medium and a development unit for visualizing electrostatic latent image, with the heating unit disposed on the back side of the surface of the latent image charge holding medium on which electrostatic latent is formed, and the ion radiator disposed in non-contact to be apart by a predetermined space on the side of the latent image charge holding medium on which electrostatic latent image is formed.

15 Claims, 6 Drawing Sheets

IMAGE RECORDING DEVICE WHICH CONDUCTS IMAGE FORMATION BY DEVELOPMENT WITH COLORING SYSTEM

BACKGROUND OF THE INVENTION

1. Field of the Invention

The present invention relates to an image recording device, more particularly, to an image recording device applied to a printer, a facsimile device, a copying machine, a display board with an image recording function, or the like and, more particularly, to an image recording device which forms image by developing electrostatic latent image generated using pyroelectric effects with a charged coloring medium.

2. Description of the Related Art

Several image recording methods have been disclosed which are realized by forming electrostatic latent image by using a pyroelectric material which will be heated to generate a charge on its surface and then developing the image with a charged coloring medium.

Bergman et al., for example, propose in U.S. Pat. No. 3,824,098 a copying device which employs a method of selectively heating a pyroelectric material (polyvinylidene fluoride (PVDF)) by lamp light permeated through the original and developing the material with coloring particles (toner). Bergman et al. note latent image generation by charges of reverse polarity in "Applied Physics Letters", Vol. 21(10), 1972, pp. 497–499. More specifically, if electric charges on the surface of a pyroelectric material generated immediately after heating (or during heating) are neutralized, electric charges whose polarity is opposite to that at the heating will be generated on the surface of the pyroelectric material when the pyroelectric material is returned to the room temperature. Latent image formed by thus obtained electric charges of reverse polarity has an advantage that it can be maintained stable in terms of time as compared with that formed by charges generated during heating. Latent image formed by the foregoing process will be hereinafter referred to as "latent image formed by a charge of reverse polarity".

Disclosed in Japanese Patent Laying-Open (Kokai) No. Showa 56-158350 is an image recording device using laser beam or a thermal head as a means of heating a pyroelectric material. In a case where this image recording device uses a thermal head, the thermal head is provided in contact with the surface of the pyroelectric material to conduct selective heating according to an image pattern, thereby generating latent image.

Furthermore, Snelling discloses in U.S. Pat. No. 5,185,619 and Japanese Patent Laying-Open (Kokai) No. Heisei 5-134506 an image recording device which conducts latent image generation, with a heating needle in contact with the surface of a pyroelectric material.

With reference to FIG. 6, basic structure of the image recording device proposed by Snelling will be described in brief. A belt-formed latent image charge holding medium 600 on which latent image is formed is composed of a pyroelectric layer 601 and a conductive layer 602. A heating needle 605 placed in contact with the pyroelectric layer 601 is controlled by a controller 608 to selectively heat the surface of the pyroelectric layer 601 in response to a picture signal. Provided on the surface of the heating needle 605 is a conductive layer 607 grounded as a charge neutralization means through which charges generated on the surface of the pyroelectric layer 601 by heating are neutralized. When the latent image charge holding medium 600 is cooled, charges of reverse polarity are generated to form latent image 640. The formed latent image 640 is developed by a development unit 610 to become toner image 641 and then the toner image is transferred to a recording medium 630 by a transfer means 620 (the Snelling device makes use of the pyroelectric effects also for this transfer means) to form image 642.

As described in the foregoing, in a case where a contact-type heating means such as a thermal head or a heating needle is employed as a heating means, conventional devices conduct heating with the heating means in contact with the surface (surface on which latent image is formed) of a latent image charge holding medium. In such a device, however, repetition of image recording is liable to cause spots on the surface of a heating means or a charge neutralization means, resulting in preventing satisfactory image recording.

In other words, small amounts of toner which has not been transferred to printing paper, paper powder, dust, etc. exist on the surface of the latent image charge holding medium and they will be gradually accumulated on the surface of the heating means or the charge neutralization means to generate spots.

In the device shown in FIG. 6, for example, spots are generated on the surface of the conductive layer 607 or the heating needle 605. Spots generated on the heating means cause problems such as a) heat resistance between the heating means and the latent image charge holding medium is increased to deteriorate heating efficiency and b) conductivity of the surface of the charge neutralization means is reduced to prevent achievement of a sufficient charge neutralization function, resulting in making stable formation of latent image difficult.

Since toner in common use has thermo-fusibility, the toner attached will be fused on the surface of a heating means due to heating of the heating means and its removal is difficult even with a cleaner etc.

Second shortcoming of the conventional devices is that since the heating means and the charge neutralization means are placed in contact with the surface of the latent image charge holding medium, stable formation of latent image is difficult and the latent image charge holding medium has a short life.

More specifically, the conventional system in which the heating means and the charge neutralization means are placed in contact with the surface of the latent image charge holding medium causes such problems as c) sliding caused by contact generates frictional electrification to disorder latent image and d) the surface of the latent image charge holding medium is scratched to disorder latent image or deteriorate durability of the latent image charge holding medium, which are bottlenecks to ensuring of device performance or reliability.

Furthermore, for color recording by the superposition of coloring particles, formation of latent image and a development process should be repeated a plurality of times on the latent image charge holding medium for every kind of coloring particles. However, a plurality of times of latent image formation and a plurality of times of execution of a development process can not be repeated in succession because spots on the surfaces of the heating means and the charge neutralization means or frictional electrification on the surface of the latent image charge holding medium will be generated as mentioned above. It is therefore necessary to once transfer latent image formed halfway by coloring particles to an intermediate transfer medium and conduct latent image formation by the following coloring particles while removing spots on the surfaces of the heating means and the charge neutralization means and frictional electrification on the surface of the latent image charge holding medium. Superposition of coloring particles thus requiring transfer to the intermediate transfer medium makes realization of small-scale and low-cost color recording difficult.

SUMMARY OF THE INVENTION

A first object of the present invention is to provide an image recording device enabling long-term stable recording by preventing spots on the surface of a heating means and the surface of a charge neutralization means and preventing frictional electrification and scratches generated on the surface of a latent image charge holding medium during heating or neutralizing.

A second object of the present invention is to provide an image recording device ensuring stable latent image formation in a long period of time and enabling a latent image charge holding medium to live long.

A third object of the present invention is to provide an image recording device which realizes small-scale and low-cost color recording requiring no intermediate transfer medium for the superposition of coloring particles by enabling latent image formation and a development process to be repeated a plurality of times on a latent image charge holding medium.

According to one aspect of the invention, Image recording device comprises

- latent image charge holding medium for forming electrostatic latent image,
- heating means for selectively heating the latent image charge holding medium for the purpose of forming electrostatic latent image on the surface of the latent image charge holding medium,
- charge neutralization means for electrically neutralizing the surface of the latent image charge holding medium, and
- development means for visualizing the electrostatic latent image, wherein
  - the heating means and the charge neutralization means are placed not in contact with the surface of the latent image charge holding medium on which electrostatic latent image is formed.

In the preferred construction, the heating means is disposed on the back side of the surface of the latent image charge holding medium on which latent image is formed.

In another preferred construction, the heating means is a thermal head placed in contact with the back side of the surface of the latent image charge holding medium on which latent image is formed.

In another preferred construction, the heating means is a heating needle placed in contact with the back side of the surface of the latent image charge holding medium on which latent image is formed.

In another preferred construction, the heating means is placed to be apart by a predetermined space on the side of the surface of the latent image charge holding medium on which latent image is formed.

In another preferred construction, the heating means is a light irradiation means placed to be apart by a predetermined space on the side of the surface of the latent image charge holding means on which latent image is formed for radiating light to conduct heating.

In another preferred construction, the heating means is a laser beam irradiation means placed to be apart by a predetermined space on the side of the surface of the latent image charge holding means on which latent image is formed for radiating laser beam to conduct heating.

In another preferred construction, the charge neutralization means is placed in non-contact to be apart by a predetermined space at a position facing the heating means with the latent image charge holding medium therebetween.

In another preferred construction, the charge neutralization means is an ion radiator which generates ions and radiates ions to the surface of the latent image charge holding medium for electrical neutralization.

In another preferred construction, the ion radiator is formed of a corotron provided with a slit for limiting an ion radiation region.

In another preferred construction, the charge neutralization means is an ion radiator placed in non-contact to be apart by a predetermined space at a position facing the heating means with the latent image charge holding medium therebetween for generating ions and radiating ions to the surface of the latent image charge holding medium for electrical neutralization.

In another preferred construction, the heating means is arranged in contact with the back side of the surface of the latent image charge holding medium on which latent image is formed, and the charge neutralization means is placed in non-contact to be apart by a predetermined space on the side of the latent image charge holding medium on which latent image is formed at a position facing the heating means with the latent image charge holding medium therebetween.

In another preferred construction, the heating means is placed to be apart by a predetermined space on the side of the surface of the latent image charge holding medium on which latent image is formed, and the charge neutralization means is placed in non-contact to be apart by a predetermined space on the side of the latent image charge holding medium on which latent image is formed at a position enabling electrical neutralization of a part heated by the heating means.

In another preferred construction, the heating means is a thermal head placed in contact with the back side of the surface of the latent image charge holding medium on which latent image is formed, and the charge neutralization means is an ion radiator placed in non-contact to be apart by a predetermined space on the side of the latent image charge holding medium on which latent image is formed at a position facing the heating means with the latent image charge holding medium therebetween for generating ions and radiating ions t o the surface of the latent image charge holding medium for electrical neutralization.

Also, the heating means is a laser beam irradiation means placed to be apart by a predetermined space on the side of the surface of the latent image charge holding means on which latent image is formed, and the charge neutralization means is an ion radiator placed in non-contact to be apart by a predetermined space on the side of the latent image charge holding medium on which latent image is formed at a position enabling electrical neutralization of a part heated by the heating means for generating ions and radiating ions to the surface of the latent image charge holding medium for electrical neutralization.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENTS

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
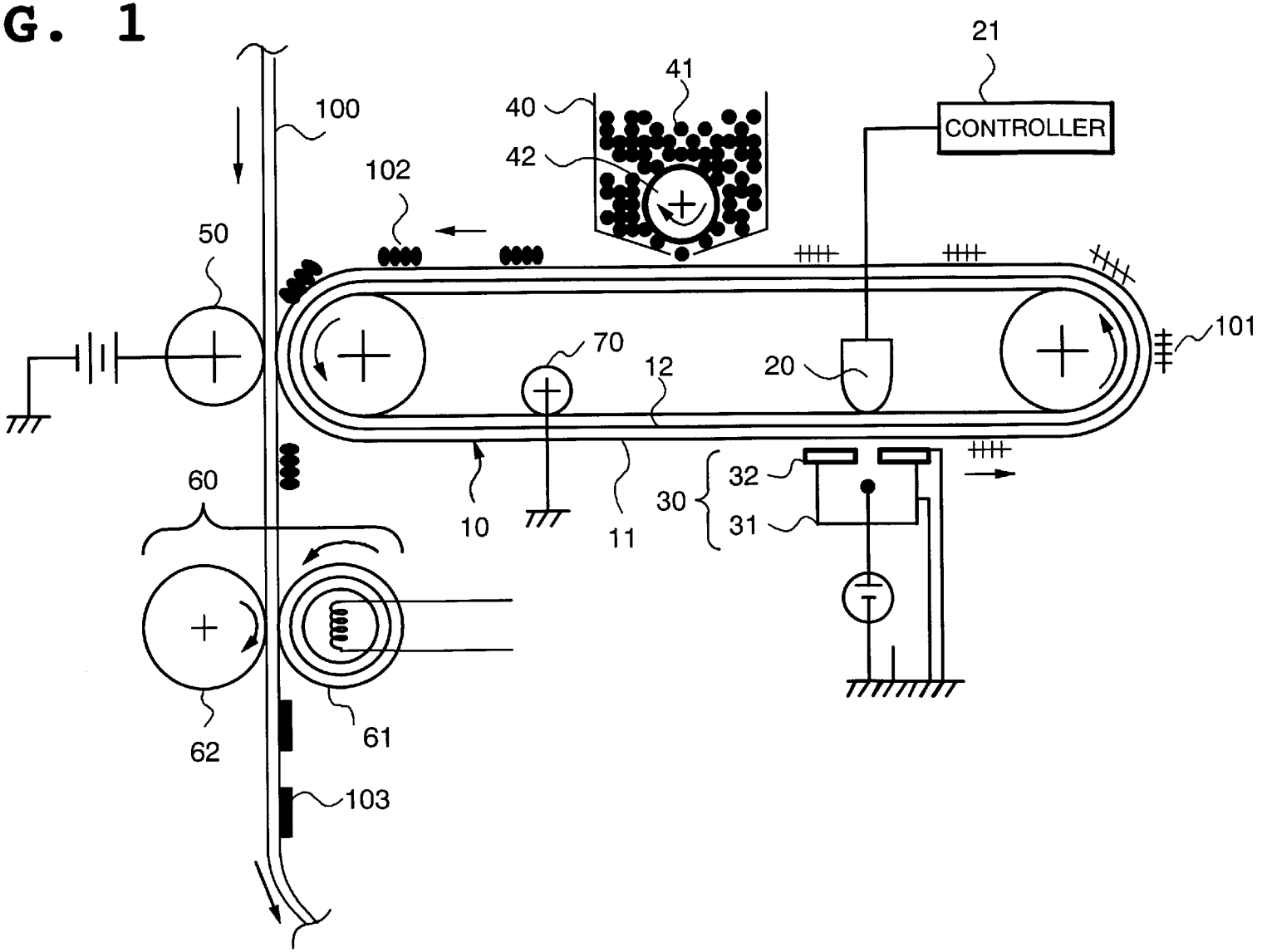
FIG. 1 is a diagram showing structure of an image recording device according to a first embodiment of the present invention.

FIG. 1 is a diagram showing structure of an image recording device according to a first embodiment of the present invention.

The image recording device of the present embodiment includes an endless-belt-formed latent image charge holding medium 10, a thermal head 20 as a heating means, an ion radiator 30 as a charge neutralization means, a development unit 40, a transfer roller 50 and a fixing unit 60.

Used as the latent image charge holding medium 10 is a belt made of an endless film composed of a pyroelectric layer 11 (about 100 $\mu$m of thickness) and a conductive layer 12 (about 0.1 $\mu$m of thickness). Used as materials of the pyroelectric layer 11 and the conductive layer 12 are PVDF and aluminum, respectively. The conductive layer 12 is maintained at a ground potential through a conductive roller 70 at any time.

The thermal head 20 used in this embodiment is a line-type thermal head commonly used for thermal transfer recording which conducts heating in contact with the side of the conductive layer 12 of the latent image charge holding medium 10. The thermal head 20 has micro-heating elements which heat due to Joule heat aligned in the direction of a width of the latent image charge holding medium 10 at a pitch of about 83 $\mu$m (300 dot/inch). Selectively causing these heating elements to heat in response to a picture signal by a controller 21 leads to heating of the latent image charge holding medium 10.

Figure 2:
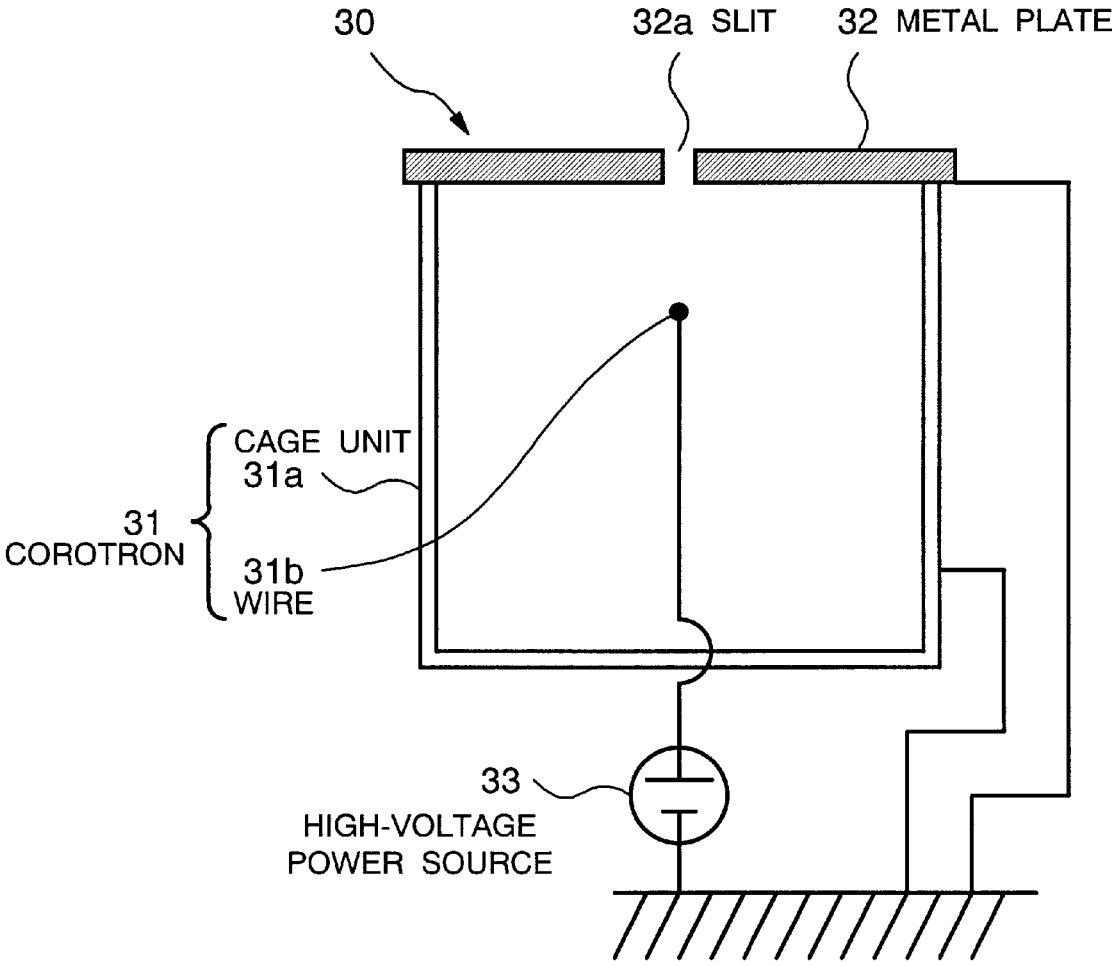
FIG. 2 is a diagram showing structure of an ion radiator of the image recording device of the present invention.

On the side of the surface of the latent image charge holding medium 10 (the side of the pyroelectric layer 11), the ion radiator 30 is placed not in contact with the pyroelectric layer so as to face the thermal head 20. As illustrated in FIG. 2, the ion radiator 30 of the present embodiment is composed of a corotron 31 which generates an ion by high electric field and a metal plate 32 having a slit 32*a* for limiting an ion radiation region. The corotron 31 is composed of a cage unit 31*a* and a wire 31*b*.

In this embodiment, the slit of the metal plate 32 is formed to be 1 mm wide in the direction of the width of the latent image charge holding medium 10 and attached to the ion radiation surface of the corotron 31. In addition, the ion radiator 30 is disposed to have its metal plate 32 located 0.5 mm apart from the surface of the latent image charge holding medium 10 and have the slit of the metal plate 32 placed substantially facing the heating elements of the thermal head 20. Then, the metal plate 32 and the cage unit 31*a* of the corotron 31 are set to a ground potential and the wire 31*b* is supplied with the 8 KV voltage by a high-voltage power source 33.

Structure of the ion radiator 30 as a non-contact charge neutralization means is not limited to that illustrated and it may be any structure that can restrict an ion radiation region. As an ion generator, a scorotron, a solid ion generator and other ion generation device may be used other than the corotron employed in the present embodiment. In addition, as a metal plate with a slit for limiting an ion radiation region, a field-control-type device which is capable of controlling the amount of ions radiated or the like may be used.

Potential of the metal plate with a slit and an applied voltage to the corotron are arbitrarily set according to the amount of currents and the amount of ions radiated by the ion radiator necessary for neutralization of charges, and a reference potential. Furthermore, position of the ion radiator may be freely set according to a heating time and heating conditions of the thermal head and heating and cooling properties of the latent image charge holding medium. It is, for example, possible to arrange an ion generator not to be faced but be displaced from the position of a heating means, thereby obliquely irradiating a heated part with ions.

Charges generated on the surface of the latent image charge holding medium 10 by heating are neutralized by ions radiated from the ion radiator 30.

Figure 3:
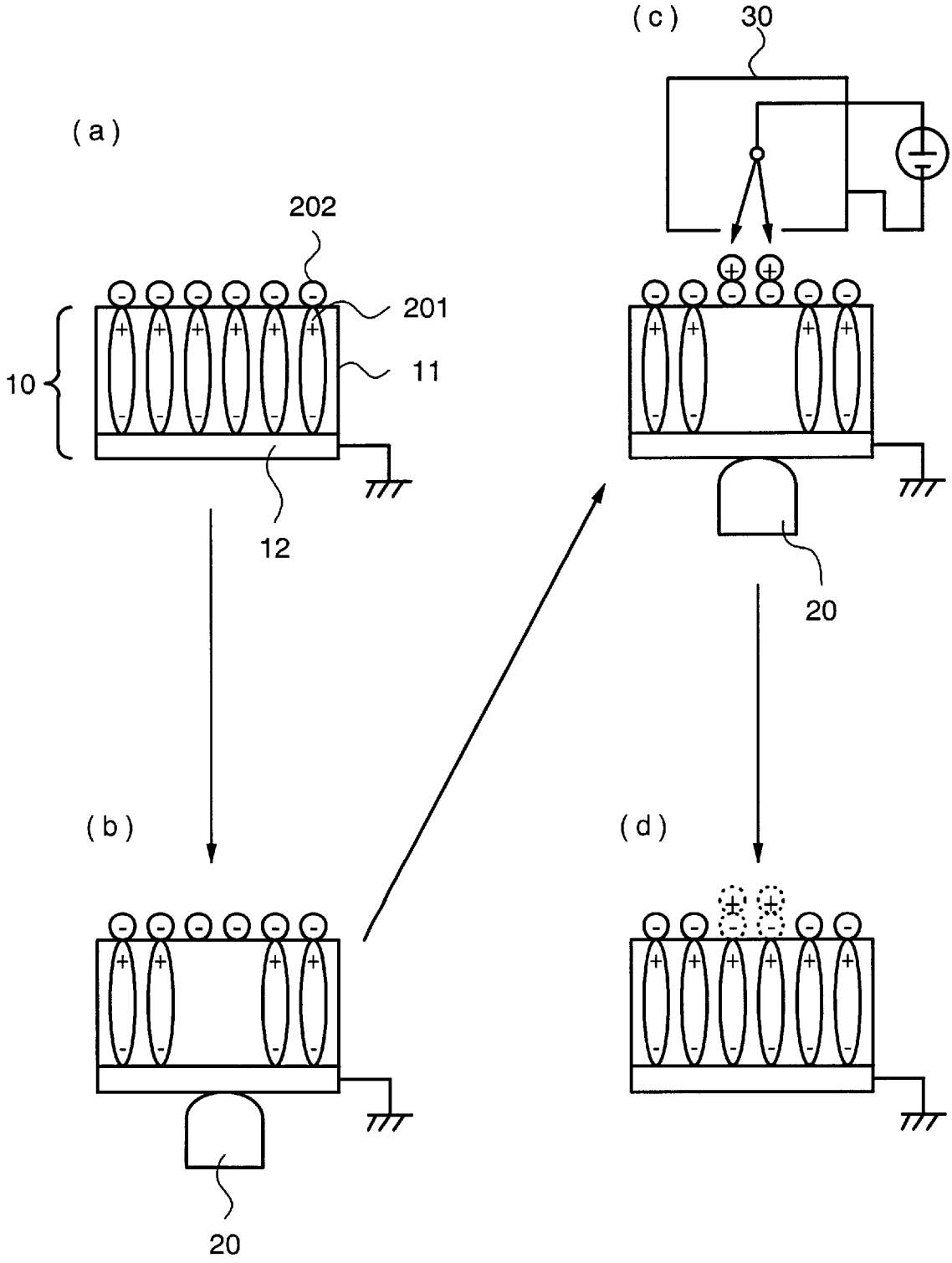
FIG. 3 is a diagram for use in explaining a latent image formation process by the image recording device of the present invention.

Here, description will be made of functions of the present invention up to the formation of latent image with reference to FIG. 3. The pyroelectric layer 11 of the latent image potential holding medium 10 has polarization charges 201 on its surface caused by spontaneous polarization of molecules and these surface charges are all being neutralized at an initial state. More specifically, floating charges existing in the air and negative charges 202 supplied from a discharging means are attached to the surface of the pyroelectric layer 11 to have an electrical neutralization state (FIG. 3(*a*)). Description will be here made assuming, as the initial state, for example, a state where the polarization charges 201 generated on the surface of the pyroelectric layer 11 due to spontaneous polarization of the pyroelectric substances have the positive polarity and the true charges 202 of the same amount as that of these positive polarity charges and having the negative polarity are attached to the surface of the pyroelectric layer 11 to assume the neutralization state.

The latent image charge holding medium 10 is selectively heated in response to a picture signal by the thermal head 20 as a heating means disposed not in contact with the latent image formation surface. At a heated part of the latent image charge holding medium 10, the temperature of the pyroelectric layer 11 increases due to the heat having permeated the conductive layer 12. As a result, a molecule orientation state of the pyroelectric layer 11 changes to decrease the amount of polarization charges 201 generated on the surface of the pyroelectric layer 11. The amount of the true charges 202 of negative polarity attached to the surface goes excessive to result in that the surface of the pyroelectric layer 11 is charged to have the negative polarity (FIG. 3(*b*)).

When to the side of the surface of the pyroelectric layer 11, ions of positive polarity are radiated from the ion radiator 30 as a charge neutralization means which is disposed at a place away from the surface for radiating ions, the ions will be drawn to the above-mentioned true charges 202 of negative polarity to trade off the charges. As a result, the surface of the pyroelectric layer 11 apparently enters the neutralization state again (FIG. 3(*c*)).

After the completion of heating, when the latent image charge holding medium 10 is cooled down to the initial temperature, the polarization state within the pyroelectric layer 11 also restores the initial state. At this time, since the surface of the pyroelectric layer 11 is already spaced apart from the ion radiator 30 as the charge neutralization means, the surface of the pyroelectric layer 11 lacks in negative charges, so that the surface of the pyroelectric layer is apparently charged to have the positive polarity (FIG. 3(*d*)). In other words, at a heated part of the latent image charge holding medium 10, latent image of positive polarity will be formed after cooling.

Although thus formed latent image will gradually disappear as a result of attachment of floating charges existing in the air, such a phenomenon takes time in occurring in general and is ordinarily maintained several hours to several tens hours. The latent image charge holding medium 10 on which the latent image is formed is developed by a charged coloring medium and is transferred and fixed as required on such a recording medium as printing paper to realize image recording.

In this embodiment, the latent image charge holding medium 10 having been heated is returned to the room temperature by spontaneous cooling to form latent image 101 by charges of opposite polarity. In this embodiment, heating the latent image charge holding medium 10 to about 40° C. has obtained about 400V of latent image potential.

The latent image 101 formed on the latent image charge holding medium 10 is developed by the development unit 40. Disposed in the development unit 40 are toner 41 (coloring particles (powder toner)) as a coloring medium and a development roller 42. The present embodiment employs the contact-type non-magnetic single component development system as a development method. On the latent image charge holding medium 10 on which development has been completed, toner image 102 is formed.

Then, superposing the latent image charge holding medium 10 on which development has been completed with printing paper 100 as a recording medium and pressing the transfer roller 50 with an applied voltage against the printing paper 100 from the back results in that the toner image 102 is electrostatically transferred to the surface of the printing paper 100.

The printing paper 100 to which the toner image 102 is transferred is passed through the fixing device 60 composed of a heat roller 61 and a pressure roller 62. Then the toner is fixed on the printing paper 100 and the image 103 is formed.

Latent image development method, kinds of developer, a method of transfer to a recording medium and a method of fixing to a recording medium are not limited to those employed in the present embodiment and the same effects can be obtained by using other systems employed in conventional electrophotographic recording. After the toner image 102 is transferred to the printing paper 100, the latent image charge holding medium 10 is again carried for latent image formation (to the side of the thermal head 20) to execute the next latent image formation.

Prior to the execution of the next formation, when toner which has not been transferred remains on the latent image charge holding medium 10, removal is conducted as required using a cleaner (not shown). When there remain latent image charges, discharging is conducted as required by using a discharging means (not shown) such as a conductive brush.

As a result of successive recording experiments executed with the device of the above-described structure, long-term stable image recording has been confirmed possible.

The present invention is not limited to above-described embodiment. While the above-described embodiment employs a line-type thermal head as a heating means, it may employ a heating means of other mode such as a serial thermal head or a heating needle. Non-contact heating method can be also employed such as laser beam or lamp heating.

In addition, while the present embodiment is structured to conduct heating from the side of the latent image charge holding means on which no latent image is formed so as to arrange the heating means not in contact with the side of the latent image charge holding medium on which latent image is formed, it may be structured to conduct heating from the side of the latent image charge holding medium on which latent image is formed as long as the heating means is not brought into contact with the side on which latent image is formed and such structure can be realized by using the above-described laser beam or lamp heating.

Figure 4:
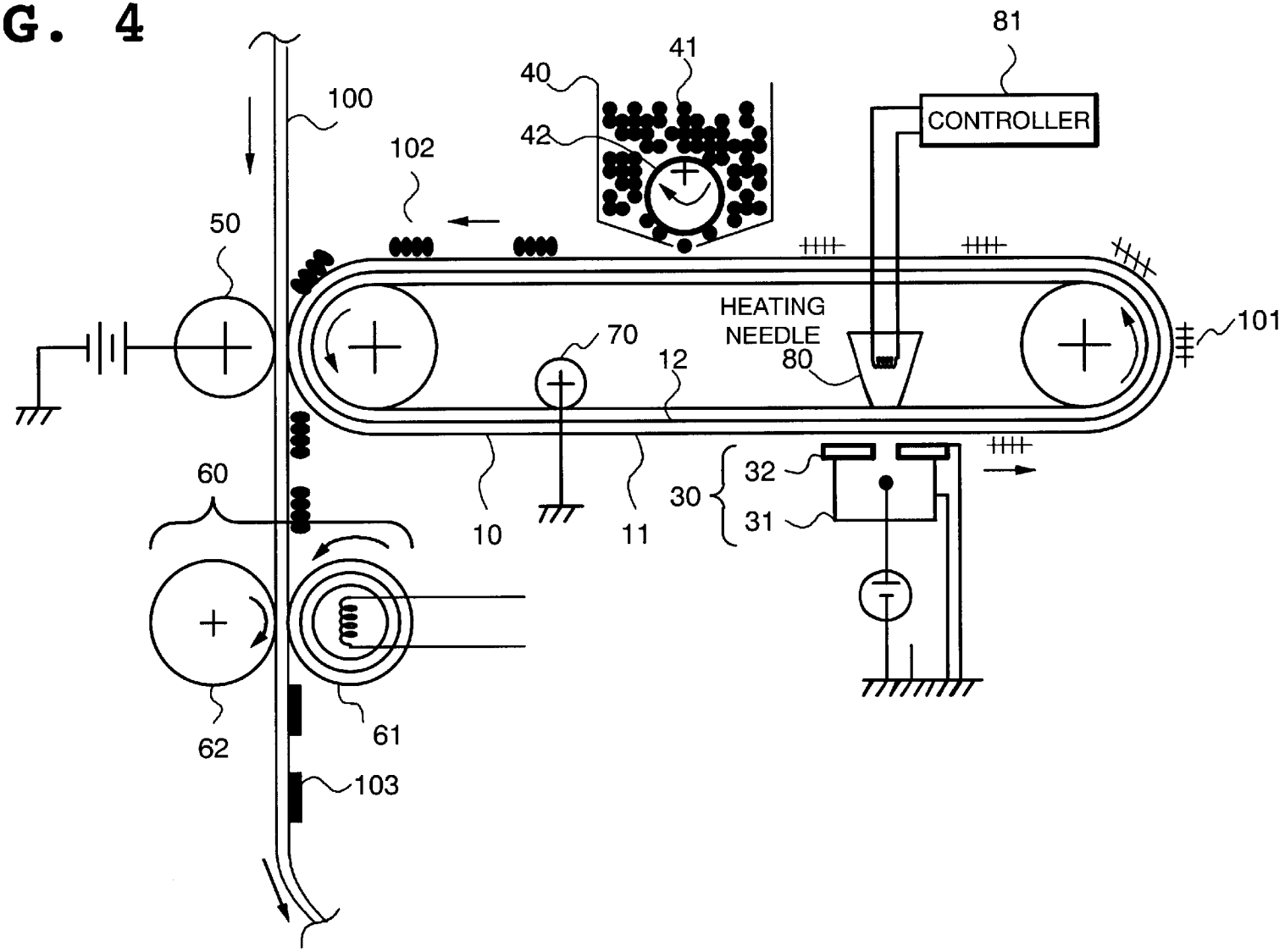
FIG. 4 is a diagram showing structure of an image recording device according to a second embodiment of the present invention.

FIG. 4 is a diagram showing structure of an image recording device according to a second embodiment of the present invention. In FIG. 4, a part common to that of the structure in FIG. 1 is allotted the same reference numeral and description of the common component is omitted. This second embodiment is structured to have, as a heating means, a heating needle 80 for conducing heating by the drive-control of a controller 81 which is arranged on the side of the conductive layer 12 of the latent image charge holding medium 10 so as to face the ion radiator 30. This embodiment is completely identical to that of FIG. 1 with the only difference being that the heating needle 80 replaces the thermal head.

Figure 5:
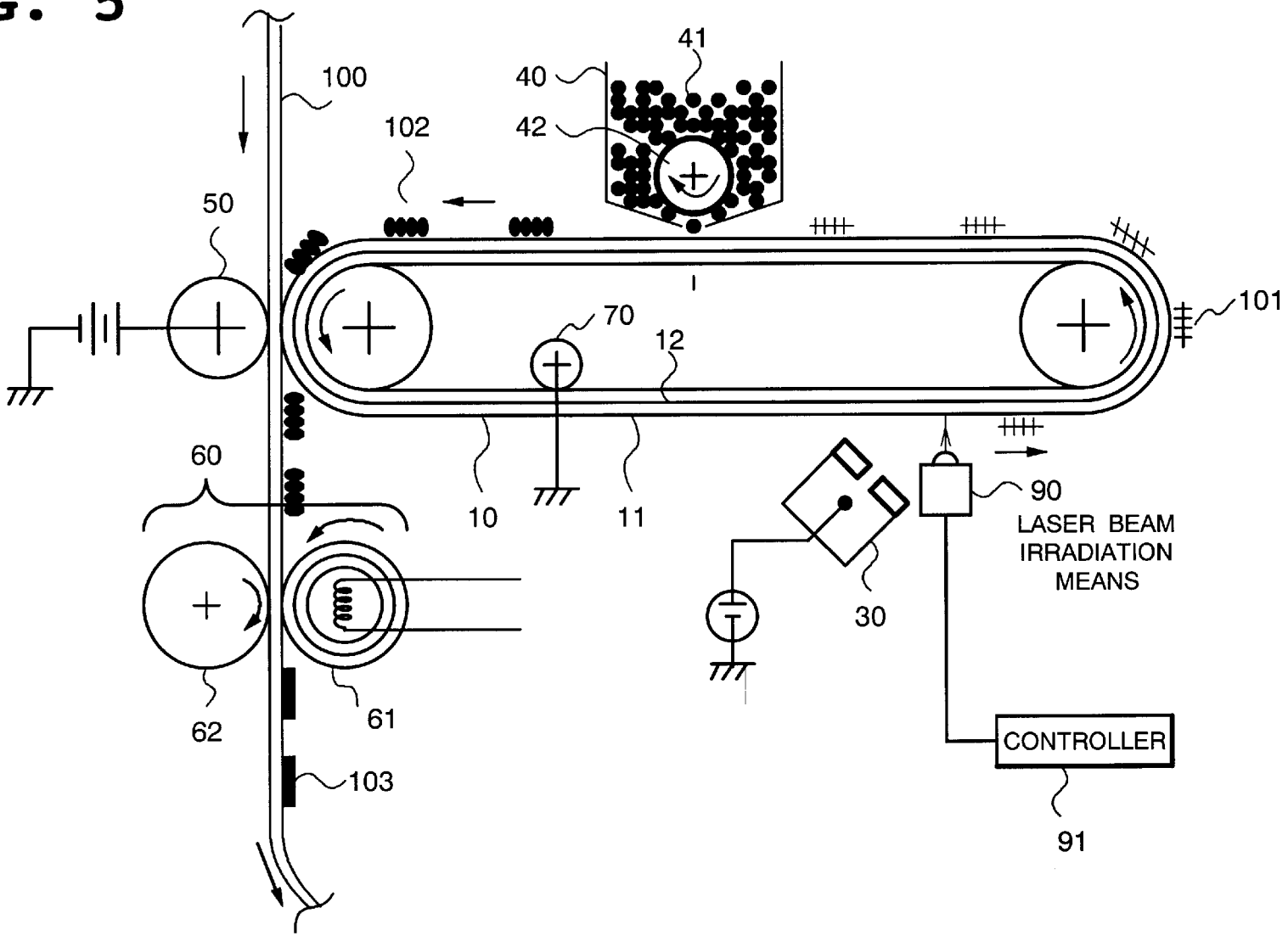
FIG. 5 is a diagram showing structure of an image recording device according to a third embodiment of the present invention.
Figure 6:
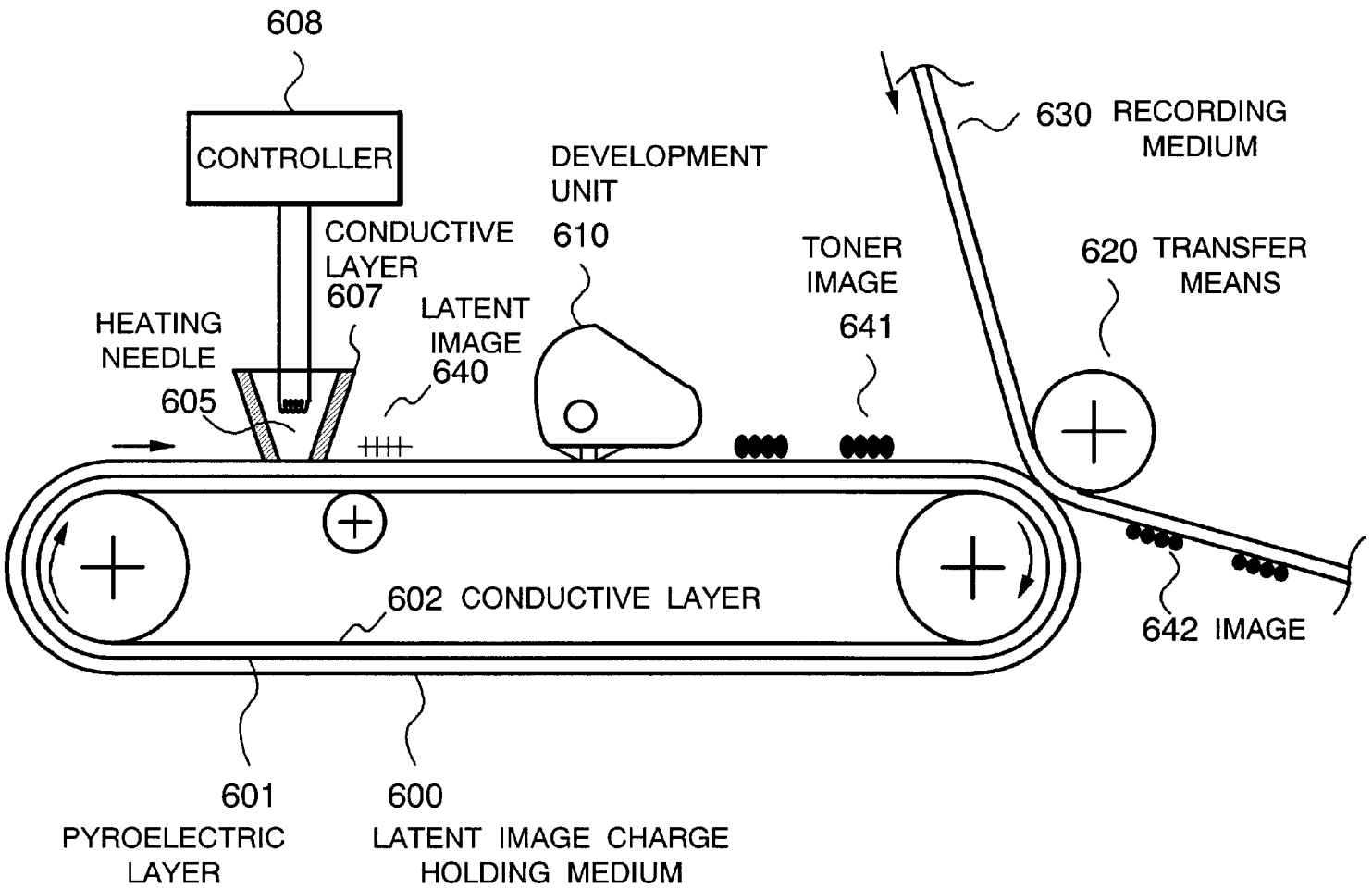
FIG. 6 (PRIOR ART)
FIG. 6 is a diagram showing structure of an image recording device according to conventional art.

FIG. 5 is a diagram showing structure of an image recording device according to a third embodiment of the present invention. In FIG. 5, a part common to that of the structure in FIG. 1 is allotted the same reference numeral and description of the common component is omitted. This third embodiment is structured to have, as a heating means, a laser beam irradiator 90 for conducing non-contact heating by the irradiation of laser beam under control of a controller 91 which is arranged in the same direction as that of the ion radiator 30 on the side of the pyroelectric layer 11 of the latent image charge holding medium 10. In addition, the ion radiator 30 is arranged to be displaced with respect to the laser beam irradiator 90, thereby obliquely radiating ions to a part heated by the laser beam irradiator 90. The remaining part of the structure is completely identical to that of FIG. 1.

Although in the above embodiment, a recording medium is assumed to be paper, it is obvious that the present invention is effective to other various recording media. Furthermore, transfer and fixing of a coloring medium to a recording medium are not always necessary, and the present embodiment is also applicable to an apparatus such as a display board with a recording function which temporarily displays information by temporarily holding a coloring medium on a recording medium or on a latent image charge holding medium. In addition, although in the above-described embodiment, a coloring medium is assumed to be coloring particles (powder toner), other type of coloring medium such as liquid toner or liquid ink may be used.

As described in the foregoing, according to the image recording device of the present invention, prevention of spots on the surfaces of a heating means and a charge neutralization means is possible even when toner yet to be transferred, paper powder, dust, etc. remain on a latent image charge holding medium. Moreover, since nothing is brought into contact with the surface of the latent image charge holding medium at the time of heating and charge neutralization, generation of frictional electrification and scratches made on the surface of the latent image charge holding medium can be prevented to enable stable latent image formation for a long period of time.

Furthermore, conducting heating and charge neutralization not in contact with the surface of the latent image charge holding medium allows repetition of latent image formation and a development process a plurality of times on the latent image charge holding medium (superposition of coloring particles) to enable development of a small-sized and low-cost color recording device which requires no intermediate transfer medium, as well as enabling the latent image charge holding medium to live long.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. Image recording device comprising:

latent image charge holding medium for forming electrostatic latent image;

heating means for selectively heating said latent image charge holding medium for the purpose of forming electrostatic latent image on a surface of said latent image charge holding medium;

charge neutralization means for electrically neutralizing the surface of said latent image charge holding medium; and development means for visualizing said electrostatic latent image; wherein said heating means and said charge neutralization means are placed not in contact with the surface of said latent image charge holding medium on which electrostatic latent image is formed.

2. The image recording device as set forth in claim 1, wherein said heating means is disposed on the back side of the surface of said latent image charge holding medium on which latent image is formed.

3. The image recording device as set forth in claim 2, wherein said heating means is a thermal head placed in contact with the back side of the surface of said latent image charge holding medium on which latent image is formed.

4. The image recording device as set forth in claim 2, wherein said heating means is a heating needle placed in contact with the back side of the surface of said latent image charge holding medium on which latent image is formed.

5. The image recording device as set forth in claim 1, wherein said heating means is placed to be apart by a predetermined space on the side of the surface of said latent image charge holding medium on which latent image is formed.

6. The image recording device as set forth in claim 1, wherein said heating means is a light irradiation means placed to be apart by a predetermined space on the side of the surface of said latent image charge holding means on which latent image is formed for radiating light to conduct heating.

7. The image recording device as set forth in claim 1, wherein said heating means is a laser beam irradiation means placed to be apart by a predetermined space on the side of the surface of said latent image charge holding means on which latent image is formed for radiating laser beam to conduct heating.

8. The image recording device as set forth in claim 1, wherein said charge neutralization means is placed in non-contact to be apart by a predetermined space at a position facing said heating means with said latent image charge holding medium therebetween.

9. The image recording device as set forth in claim 1, wherein said charge neutralization means is an ion radiator which generates ions and radiates ions to the surface of said latent image charge holding medium for electrical neutralization.

10. The image recording device as set forth in claim 9, wherein said ion radiator is formed of a corotron provided with a slit for limiting an ion radiation region.

11. The image recording device as set forth in claim 1, wherein said charge neutralization means is an ion radiator placed in non-contact to be apart by a predetermined space at a position facing said heating means with said latent image charge holding medium therebetween for generating ions and radiating ions to the surface of said latent image charge holding medium for electrical neutralization.

12. The image recording device as set forth in claim 1, wherein said heating means is arranged in contact with the back side of the surface of said latent image charge holding medium on which latent image is formed, and said charge neutralization means is placed in non-contact to be apart by a predetermined space on the side of said latent image charge holding medium on which latent image is formed at a position facing said heating means with said latent image charge holding medium therebetween.

13. The image recording device as set forth in claim 1, wherein said heating means is placed to be apart by a predetermined space on the side of the surface of said latent image charge holding medium on which latent image is formed, and said charge neutralization means is placed in non-contact to be apart by a predetermined space on the side of said latent image charge holding medium on which latent image is formed at a position enabling electrical neutralization of a part heated by said heating means.

14. The image recording device as set forth in claim 1, wherein said heating means is a thermal head placed in contact with the back side of the surface of said latent image charge holding medium on which latent image is formed, and said charge neutralization means is an ion radiator placed in non-contact to be apart by a predetermined space on the side of said latent image charge holding medium on which latent image is formed at a position facing said heating means with said latent image charge holding medium therebetween for generating ions and radiating ions to the surface of said latent image charge holding medium for electrical neutralization.

15. The image recording device as set forth in claim 1, wherein said heating means is a laser beam irradiation means placed to be apart by a predetermined space on the side of the surface of said latent image charge holding means on which latent image is formed, and said charge neutralization means is an ion radiator placed in non-contact to be apart by a predetermined space on the side of said latent image charge holding medium on which latent image is formed at a position enabling electrical neutralization of a part heated by said heating means for generating ions and radiating ions to the surface of said latent image charge holding medium for electrical neutralization.

* * * * *